US007780157B2

(12) United States Patent
Brünner et al.

(10) Patent No.: US 7,780,157 B2
(45) Date of Patent: Aug. 24, 2010

(54) STITCHING DEVICE AND SADDLE STITCHER HAVING THE STITCHING DEVICE

(75) Inventors: Torsten Brünner, Zweenfurth (DE); Steffen Hoffmann, Leipzig (DE); Holger Klamt, Leipzig (DE); Siegmar Tischer, Borsdorf (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 144 days.

(21) Appl. No.: 12/207,021

(22) Filed: Sep. 9, 2008

(65) Prior Publication Data

US 2009/0085272 A1 Apr. 2, 2009

(30) Foreign Application Priority Data

Oct. 1, 2007 (DE) ..... 10 2007 047 050

(51) Int. Cl.
*B42B 4/00* (2006.01)

(52) U.S. Cl. ..... 270/52.18; 270/58.08; 227/84; 227/93

(58) Field of Classification Search ..... 270/58.08, 270/52.18; 227/84, 92, 93
See application file for complete search history.

(56) References Cited

U.S. PATENT DOCUMENTS 5,516,024 A 5/1996 Hohner et al.

FOREIGN PATENT DOCUMENTS

DE 44 44 220 A1 7/1995
EP 0 916 514 A1 5/1999

*Primary Examiner*—Patrick Mackey
(74) *Attorney, Agent, or Firm*—Laurence A. Greenberg; Werner H. Stemer; Ralph E. Locher

(57) ABSTRACT

A device for stitching collated printed products, in particular signatures, with staples, includes a stitching head base body, a former, a clincher, a staple support and a driver. The former has a supporting projection and a control projection. The supporting projection extends beyond a contour of the control projection. A saddle stitcher having a stitching device is also provided.

9 Claims, 9 Drawing Sheets

STITCHING DEVICE AND SADDLE STITCHER HAVING THE STITCHING DEVICE

CROSS-REFERENCE TO RELATED APPLICATION

This application claims the priority, under 35 U.S.C. §119, of German Patent Application DE 10 2007 047 050.0, filed Oct. 1, 2007; the prior application is herewith incorporated by reference in its entirety.

BACKGROUND OF THE INVENTION

Field of the Invention

The invention relates to a device for stitching collated printed products, in particular folded signatures, with wire staples, including a stitching head base body having a former, a clincher, a staple support and a driver. The former has a supporting projection and a control projection. The invention also relates to a saddle stitcher having the stitching device.

Devices with different construction and performance are used in the further processing of printed products to stitch folded signatures or printed products. For example, the use of stitching heads in saddle stitchers is very common. In saddle stitchers, individual folded printed products are deposited on a transport chain or the like, are gathered and collated. Then they are stitched in a stitching station and, if desired, fed to a further processing unit for edge trimming, to a delivery, or the like. Such a saddle stitcher has become known, for example, from European Patent Application EP 0 916 514 A1.

The known saddle stitcher includes a stitching station in which folded sheets that rest on each other are stitched by a staple, in particular a wire staple. That is done by stitching heads, which are disposed above the saddle chain, and clinchers, which are disposed between the saddle chains instead of the guide rail. The clinchers bend the free ends of the staples which have been punched through the folded sheets. Stitching stations and stitching heads used for that purpose are known, for example, from German Patent DE 44 44 220 C2.

The stitching head described in German Patent DE 44 44 220 includes a former and a clincher which cooperate to form staples out of pieces of wire. A staple support guides the staples which have been formed in grooves of the clincher. A driver moves the staple towards the product to be stitched or stapled and drives it through the product. Below the product, at the stitching position, there are clinchers or stitching plates with cup-shaped recesses for bending the legs of the staple. The clincher and the driver are driven by piston rods connected to a cam control mechanism.

A disadvantage of stitching heads of that type is that once the staple has been formed, the legs of the staple protrude from the clincher. Up until the actual stitching operation, the legs of the staple may become deformed, in particular by products entering the stitching area. Deformed staples may be difficult to introduce into the product.

SUMMARY OF THE INVENTION

It is accordingly an object of the invention to provide a stitching device and a saddle stitcher having the stitching device, which overcome the hereinafore-mentioned disadvantages of the heretofore-known devices of this general type and which optimize staple guidance.

With the foregoing and other objects in view there is provided, in accordance with the invention, a device for stitching collated printed products, in particular folded signatures, with wire staples. The device comprises a stitching head base body having a former, a clincher, a staple support and a driver. The former has a supporting projection and a control projection with a contour. The supporting projection extends beyond the contour of the control projection.

The supporting projection is provided for supporting a piece of wire and the control projection is provided for controlling pivoting movement. In this context, the control projection cooperates with a control edge of the driver. In accordance with an advantageous embodiment, the support area of the former is elongated as far as the control edge of the driver in order for the piece of wire to be pulled into bending grooves of the clincher to the maximum extent and thus to achieve a favorable resting position when the staple support is pivoted inward.

In accordance with another feature of the invention, the contour of the control projection is curved. This feature ensures that the pivoting movement and the length of the supporting projection match to an optimum extent.

In accordance with a further feature of the invention, the staple support has a curved guide surface with lateral support areas which are provided with recesses. These recesses are advantageously spatial chamfers formed at an angle of approximately 30° and terminate shortly in front of the tip of the staple support. An advantage of this feature is that the guide face, that rests against the back of the staple when the support has been pivoted in, which is also known as staple support areas, cannot become jammed because the recesses provide sufficient clearance to accommodate tolerances. Nevertheless, the staple is supported over its entire width in the region of the tip of the staple support.

In accordance with a concomitant feature of the invention, the staple support is supported in the clincher so as to be capable of pivoting. The pivoting movement of the staple support is controlled by a control curve and a control cam in cooperation with a control roller. An advantage of this feature is that, especially when thick wires or slightly soiled or corroded wires are being used which require more force during the stitching operation, the staple support positions the piece of wire in the clincher in a form-locking way. A form-locking connection is one which connects two elements together due to the shape of the elements themselves, as opposed to a force-locking connection, which locks the elements together by force external to the elements.

Other features which are considered as characteristic for the invention are set forth in the appended claims.

Although the invention is illustrated and described herein as embodied in a stitching device and a saddle stitcher having the stitching device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
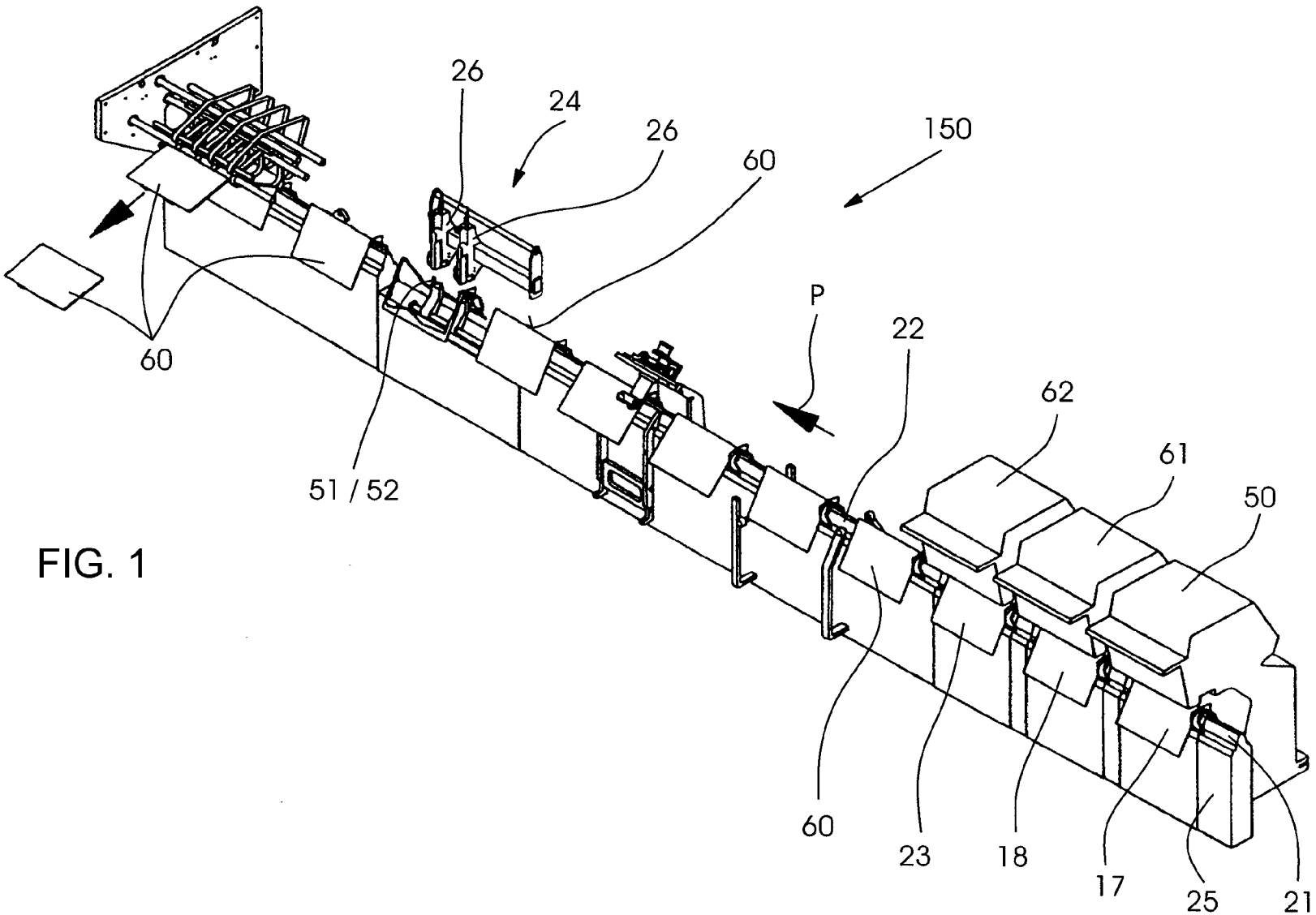
FIG. 1 is a simplified, diagrammatic, perspective view of a saddle stitcher including a stitching station in accordance with the prior art.

Referring now to the figures of the drawings in detail and first, particularly, to FIG. 1 thereof, there is seen a typical saddle stitcher indicated by reference numeral 150. The saddle stitcher 150 includes a saddle chain 22 as a transport device. Individual folded sheets or folded signatures 17, 18, 23 are taken from stacks provided in signature feeders 50, 61, 62 and are deposited on the saddle chain 22. A guide rail 25 is provided below the saddle chain 22. An upper section 21 of the guide rail 25 is formed like a blade. A straight portion of the guide rail 25 defines a transport and stitching line. The saddle chain 22, together with the guide rail 25, forms a substantially roof-shaped support on which collated folded sheets 60 are moved in straddling formation towards a stitching station 24 in a direction indicated by an arrow P. The folded sheets 60 are stitched by staples in the stitching station 24. Stitching heads 26, which are disposed above the saddle chain 22, and pairs of clinchers 51, 52, which are provided below the saddle chain 22 to clinch or bend free ends of the staples which have been introduced into the stack of folded sheets 60 by the stitching heads 26, are used to stitch the folded sheets 60.

Figure 2:
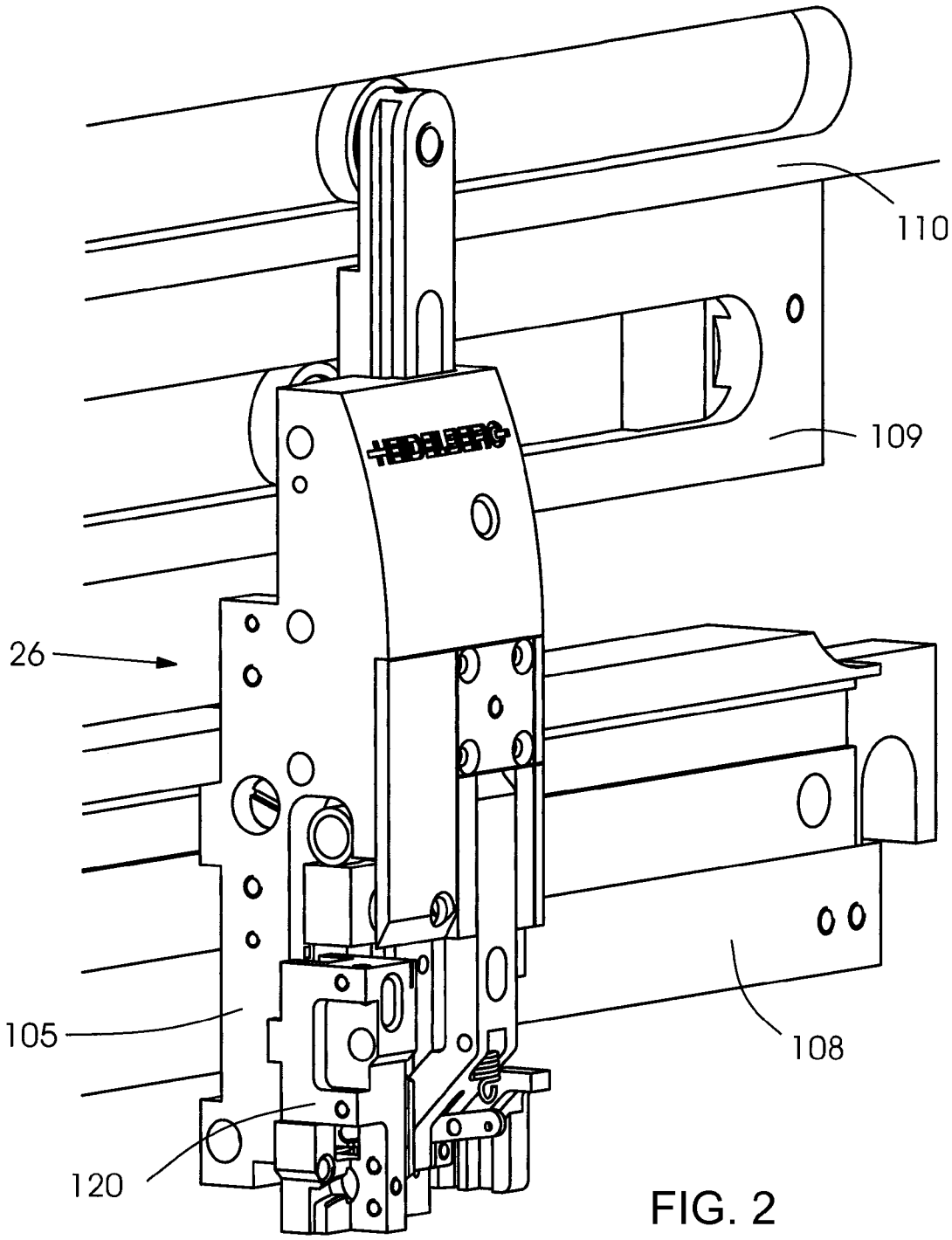
FIG. 2 is a fragmentary, perspective view of a prior art stitching head guided in a stitching station of the saddle stitcher shown in FIG. 1.

FIG. 2 illustrates one of the stitching heads 26 shown in FIG. 1 as part of the stitching station 24 of the saddle stitcher 150, in greater detail. A stitching head base body 105 is firmly connected to a receiving rail 108 which carries out a cyclical horizontal movement during which the stitching head is brought to a transport speed of the stack of collated folded sheets 60 to be stitched. In addition to the lateral displacement of the receiving rail 108, a non-illustrated slider and a non-illustrated driver slider are moved vertically through grooves formed in two control rails 109 and 110. Other movements of the stitching device are derived from the relative movement between the driver slider and the slider.

A cut-off box 120 is disposed on the stitching head base body 105. A non-illustrated stitching wire is introduced into the stitching head base body 105, where it is cut in accordance with the required length of wire. The required length of wire depends, for example, on the thickness of the stack to be stitched and on the type of wire stitching. The stitching head of the invention will be described below. The illustration and description are limited to important components.

Figure 3:
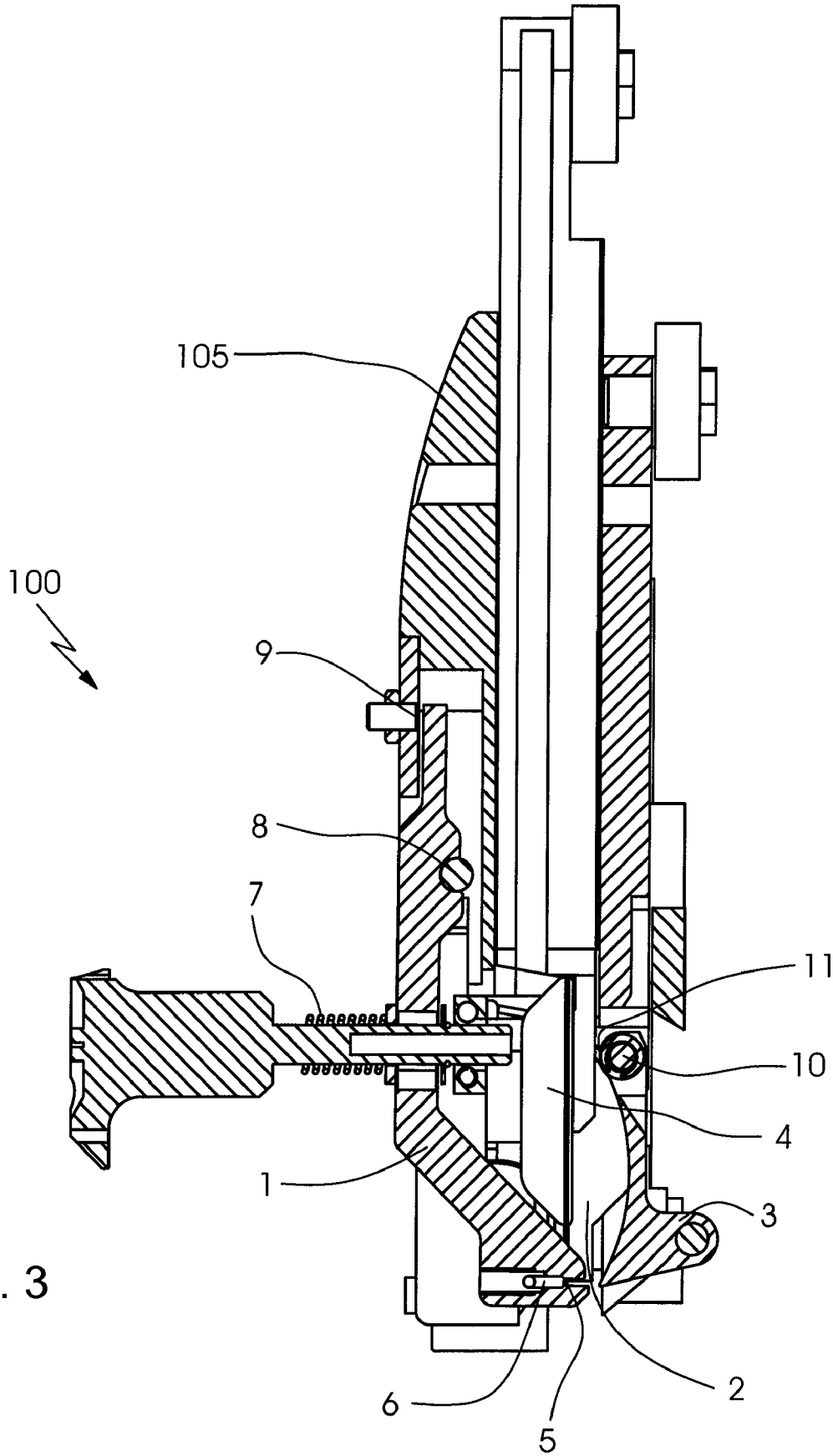
FIG. 3 is a longitudinal-sectional view of a stitching head in a first operating position.
Figure 4:
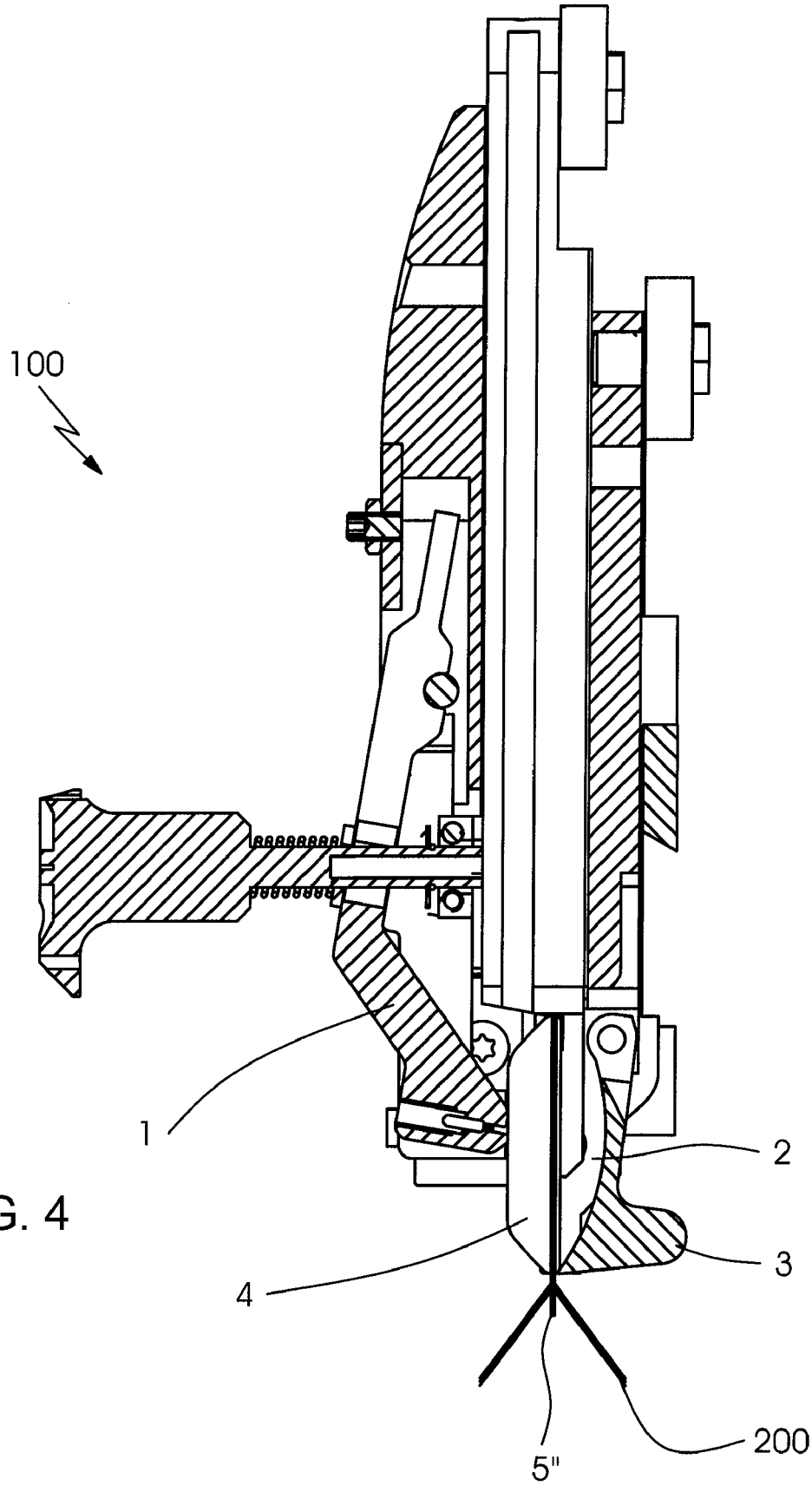
FIG. 4 is a longitudinal-sectional view of a stitching head in a second operating position.

FIGS. 3 and 4 illustrate two different operating positions of a stitching head 100 in accordance with the invention. The important elements of the stitching head 100 are a former 1, a clincher 2, a staple support 3 and a driver 4.

During a staple forming and stitching operation, the driver 4 and the clincher 2 are moved vertically downward together with the staple support 3. The downward movement of the driver 4 causes the former 1 to pivot about a pivot 8 against the action of a spring 7. The pivoting movement is limited by a first, adjustable stop 9 and a second stop formed by the driver 4. It can be seen that in FIG. 3, the former 1 rests against the adjustable stop 9, whereas in FIG. 4, the former 1 rests against the driver 4. The staple support 3 pivots about a pivot 10. The pivoting movement is caused by the action of a torsion spring 11 and by the downward movement of the clincher 2. The staple support 3 has a control roller 33 which rolls on a control curve 12 (see FIGS. 5A-5D).

The following is a brief description of the staple forming operation. A piece of wire 5, which has been cut to a suitable length in the cut-off box 120, is fed to the former 1, where it is held by a magnet 6. The clincher 2 is moved vertically downward towards the piece of wire 5. As is shown in FIG. 7, the clincher 2 includes two rails with a respective inner guide groove 20, which are also known as clincher grooves. When the clincher 2 meets the ends of the piece of wire 5 that protrude from the former 1, these ends are bent by approximately 90° into the guide grooves 20. These bent ends of the piece of wire 5 form legs of a staple 5" and an unbent central piece forms a yoke or crown. As soon as the staple 5" has been formed, the former 1 is pivoted away and the staple support 3 is pivoted in. The task of the staple support 3 is to support the staple 5" as long as possible, i.e. to guide the yoke or crown of the staple 5" and to stabilize the legs of the staple 5" in the guide grooves 20 of the clincher 2 (also see FIG. 6). Thus, the legs of the staple 5" are prevented from buckling.

FIG. 4 illustrates the stitching head 100 at a later point in time. The staple forming operation has been completed, and the staple 5" has been driven into a product 200 by the driver 4. Stitching plates or clinchers, which are used to bend the legs of the staple 5" and are located underneath the product 200, are not illustrated. The former 1 and the staple support 3 have been displaced by the driver 4. At the stitching instant, the driver 4 is located at its lowest point. Subsequently, it will be moved vertically upward again.

Figure 5A:
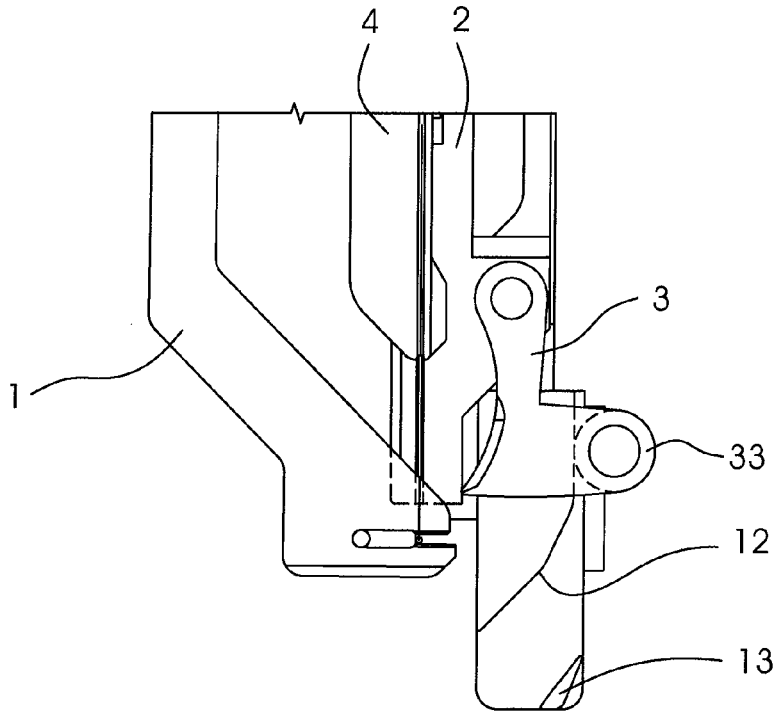
FIGS. 5A-5D are enlarged side-elevational views illustrating a staple which has been formed as it is guided by a staple support at different instants.
Figure 5B:
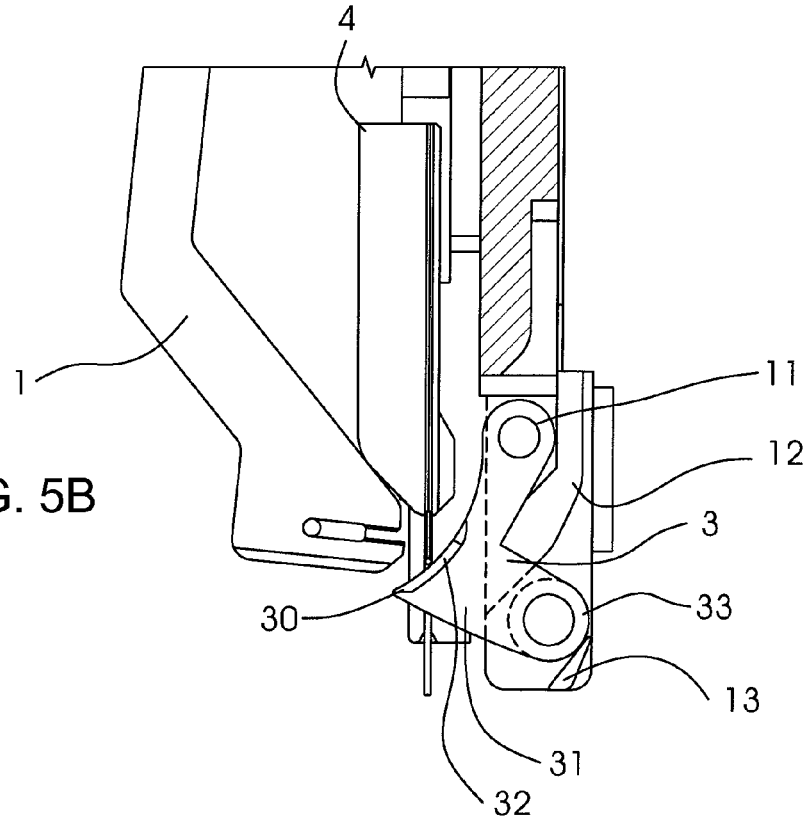
Figure 5C:
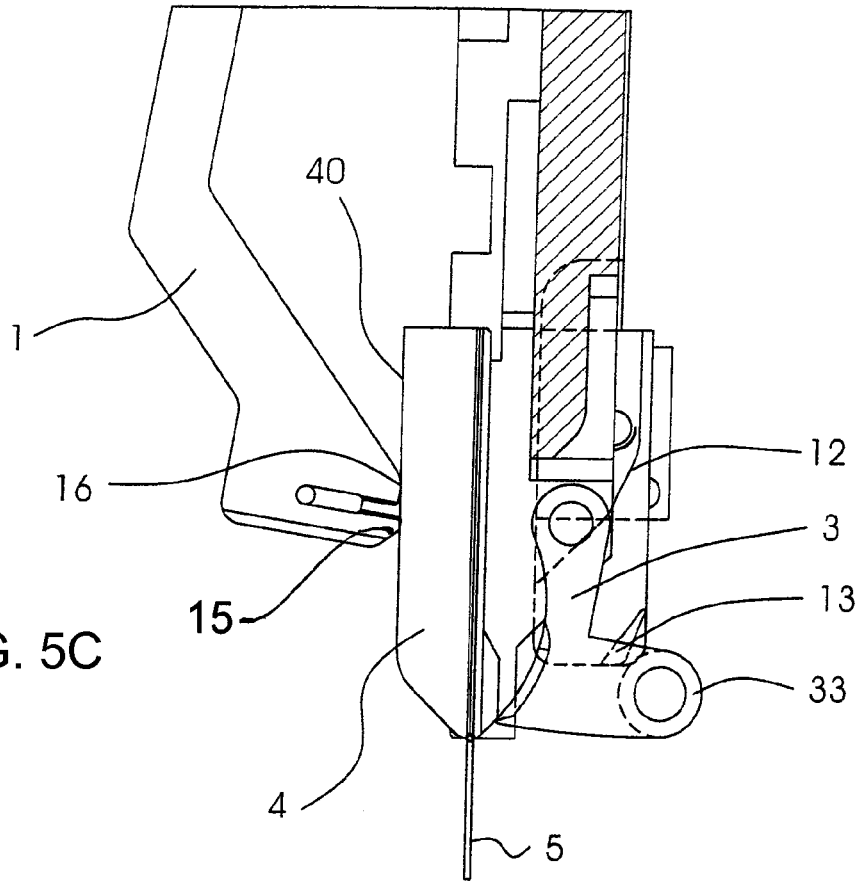
Figure 5D:
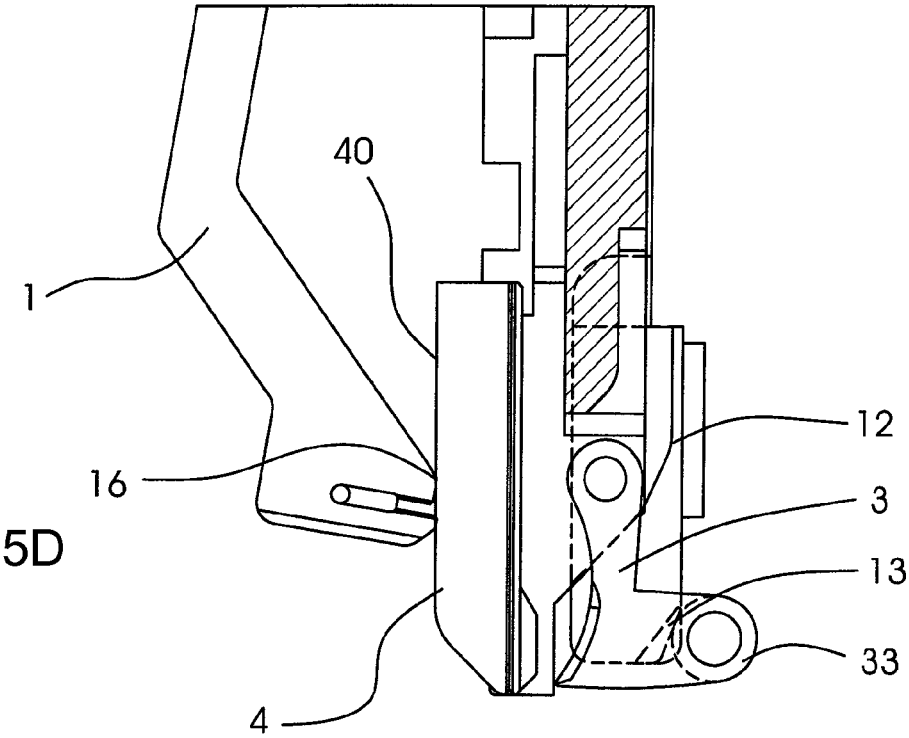

FIGS. 5A-5D illustrate the staple forming operation, in particular the sequence of movements of the staple support 3. FIG. 5A illustrates an instant shortly before the start of a staple-forming operation. The control roller 33 of the staple support 3 contacts a vertical curve segment of the control curve 12 and maintains the staple support 3 in a position in which it is pivoted away. As the clincher 2 moves further downward, the staple-forming operation is initiated. The staple support 3 is moved downward together with the clincher 2. In the process, the control roller 33 follows the control curve 12 and causes the staple support 3 to pivot in to ensure that the staple 5" will be supported from the instant in which it is formed. As a result of the frictional force of the staple 5" in the clincher 2, a force which quickly becomes greater than the force of the torsion spring 11, especially with thick wires, the staple 5" would be moved vertically downward with the clincher, and the staple support 3 would be pivoted away. In order to avoid that, the stitching head 100 includes a control cam 13, which continues to maintain the staple support 3 in the support position in order for the staple support 3 to be able to carry out its supportive and guiding function for a longer period of time. Consequently, the legs of the staple 5" do not protrude from the clincher 2. In the process, as is shown in FIG. 5B, the control roller 33 of the staple support 3 rolls on the control cam 13. The staple support 3 is not pivoted away as shown in FIG. 5C until a further downward movement of the driver 4, i.e. shortly before the stitching operation. When the driver 4 and the clincher 2 together with the staple support 3 move upward, the control roller 33 moves along the side of the control cam 13 facing away from the driver as shown in FIG. 5D.

Moreover, FIGS. 5C and 5D illustrate how the pivoting movement of the former 1 is controlled. A control projection 16 of the former 1 extends beyond a supporting projection 15 and cooperates with a front face 40 of the driver as the latter moves upward and downward.

Figure 6:
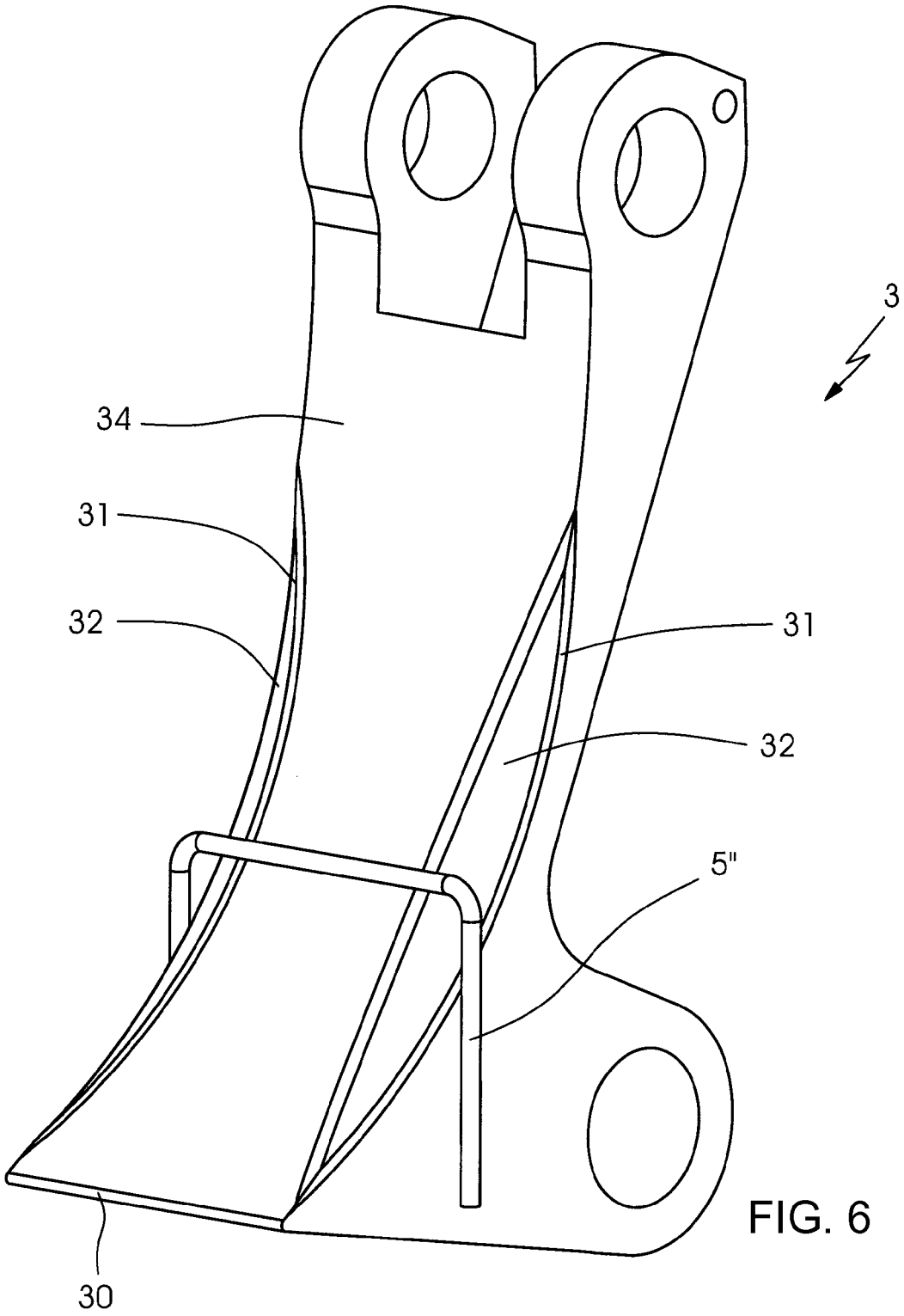
FIG. 6 is a further enlarged, perspective view of a staple support.
Figure 7:
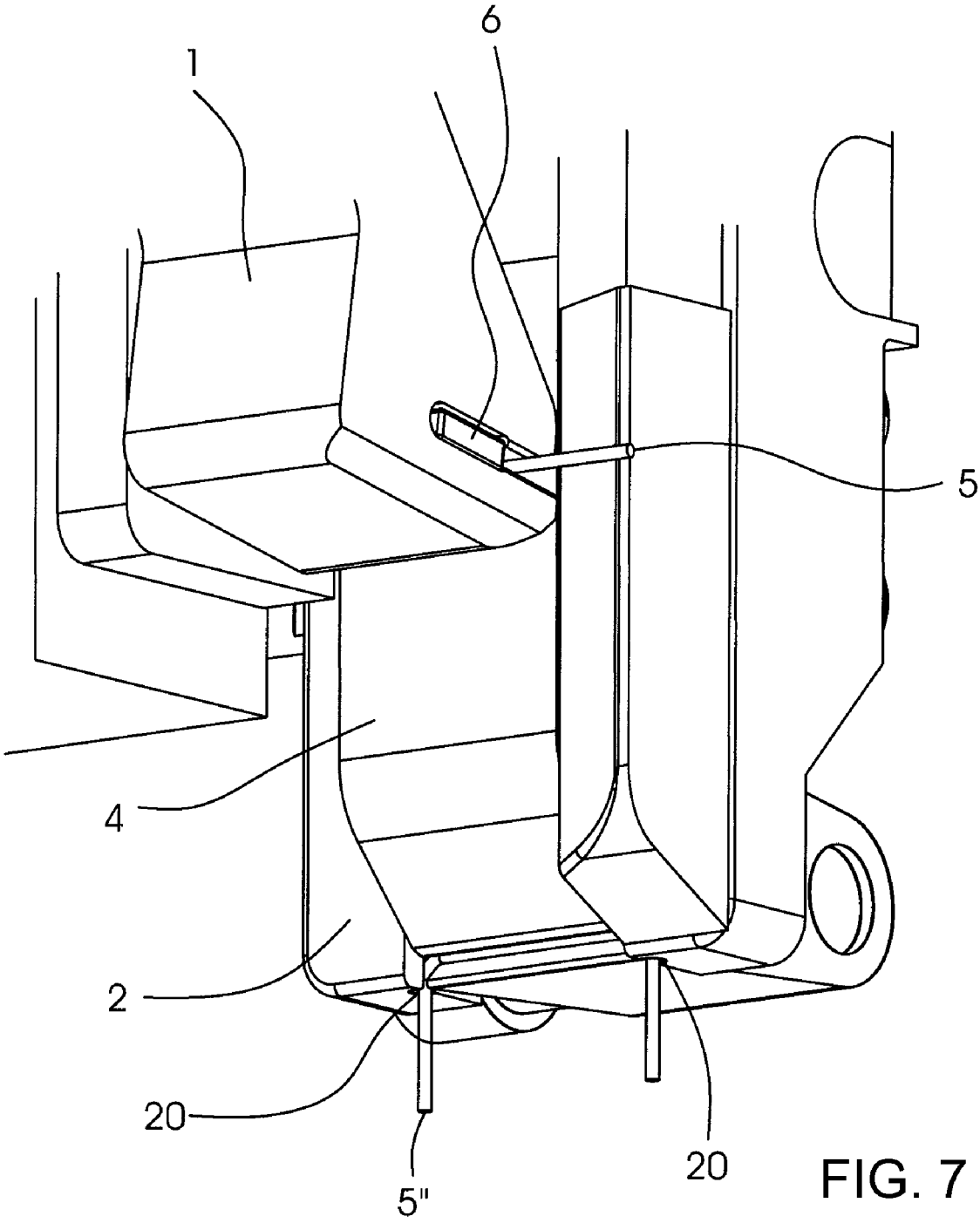
FIG. 7 is a fragmentary, perspective view of a portion of a stitching head shortly before a stitching operation.

FIG. 6 illustrates a staple support 3 of a stitching head 100 in accordance with the invention, in greater detail. The staple support 3 includes a curved guide surface 34 which guides the yoke or crown of the staple 5" and along which the yoke or crown of the staple 5" slides. Furthermore, the staple support 3 includes two lateral support surfaces 31 which hold the legs of the staple 5" in the guide grooves 20 of the clincher 2 (seen in FIG. 7). In areas where the guide surface 34 and the support surface 31 meet, the staple support 3 has a respective recess in the shape of a bevel or recess 32, for example formed by a spatial chamfer at an angle of approximately 30°. In principle, any angle between 20° and 40° is conceivable. The bevel 32 prevents the clincher 2, the staple 5" and the staple support 3 from getting jammed. However, the bevel 32 does not extend as far as a tip 30 of the staple support 3. Thus, the support surfaces 31 are effective across the entire width in the tip 30 of the staple support 3. Therefore, the staple 5" can advantageously be guided for a longer period of time.

The position of the guide grooves 20 of the clincher 2, which have been described above, becomes apparent from FIG. 7. FIG. 7 also shows that the former 1 is supplied with a new piece of wire 5 even while the staple 5" which has just been formed is introduced into a non-illustrated product 200. Thus, the stitching speed or cycle of the stitching head 100 is increased.

Figure 8:
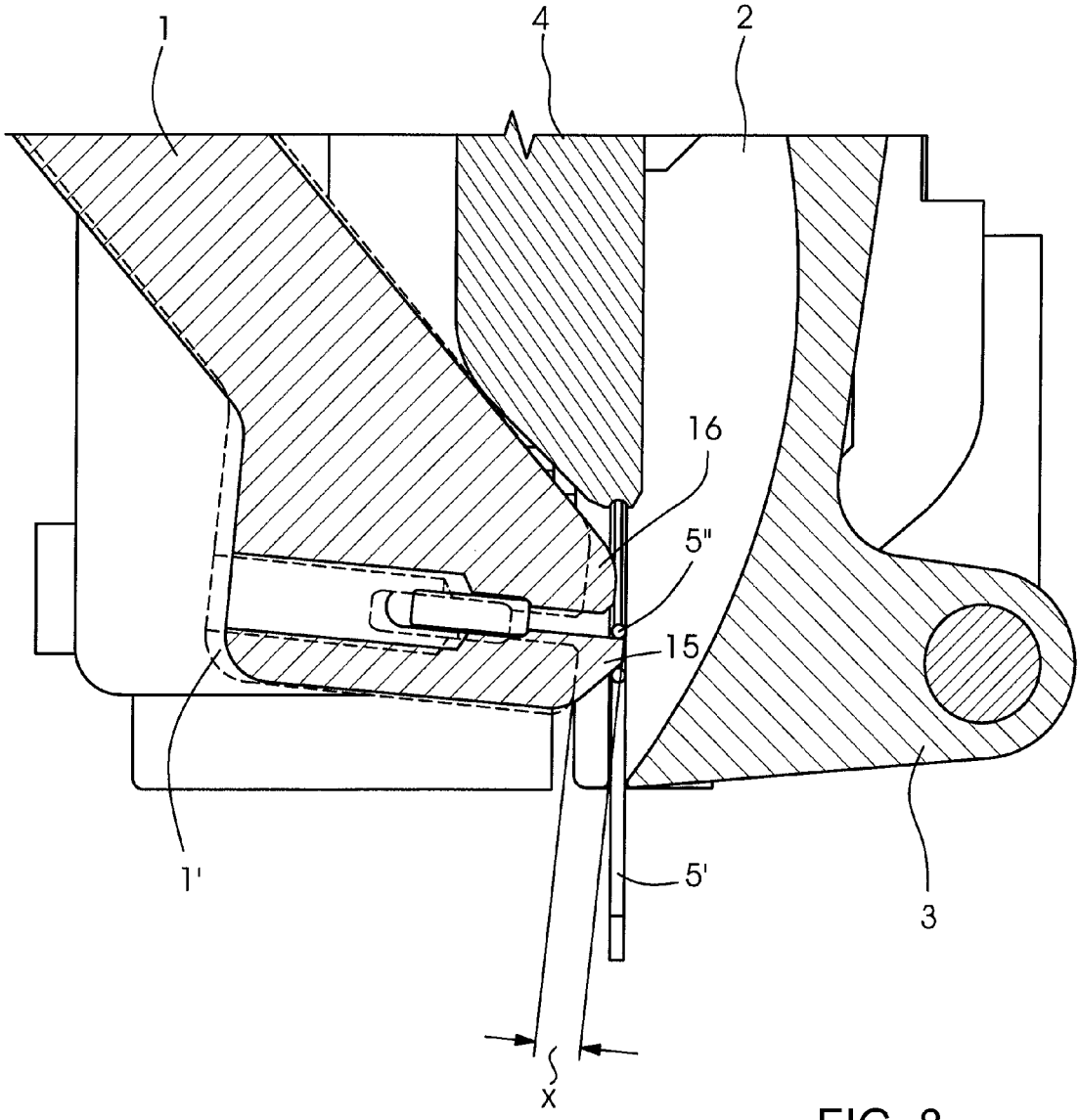
FIG. 8 is a cross-sectional view of a portion of two different formers.

FIG. 8 is an enlarged view showing of an instant of completion of the staple forming operation. The driver 4 continues to be moved vertically downward to introduce the completed staple 5', 5" into a non-illustrated product 200. The staple support 3 is pivoted in to support the staple 5', 5". FIG. 8 illustrates two alternative embodiments of the former 1, 1'. One is a prior art embodiment of a former 1', and one is a former 1 in accordance with the invention. The outer contour of the former 1 of the invention is illustrated in thicker lines. The outer contour of the prior art former 1' is indicated in dashed lines. Thus, it is apparent that the former 1 includes the supporting projection 15. The function of this supporting projection 15 is to support the staple 5" for a longer period of time and to delay its downward movement. The former 1' does not have such a supporting projection. Consequently, the staple 5' is already at a lower position, and the legs of the staple 5' protrude from the clincher 2. In order to form the supporting projection 15, the lower jaw of the former 1 is elongated by an amount x compared to the lower jaw of the former 1'.

The invention claimed is:

1. A device for stitching collated printed products or folded signatures with wire staples, the device comprising:

a stitching head base body having a former, a clincher, a staple support and a driver;

said former having a supporting projection and a control projection with a contour; and said supporting projection extending beyond said contour of said control projection.

2. The device according to claim 1, wherein said contour of said control projection has a curved shape.

3. The device according to claim 1, wherein said staple support has a curved guide face for guiding a crown of a formed staple and along which the crown of the formed staple slides.

4. The device according to claim 3, wherein said guide face has two lateral support areas and recesses in said two lateral support areas.

5. The device according to claim 4, wherein said recesses are spatial chamfers at an angle of approximately 30°.

6. The device according to claim 4, wherein said staple support has a tip, and said recesses end in front of said tip.

7. The device according to claim 1, wherein said staple support is pivotally supported in said clincher.

8. The device according to claim 7, which further comprises a control roller, and a control curve and a control cam cooperating with said control roller for controlling pivoting movements of said staple support.

9. A saddle stitcher, comprising a stitching device according to claim 1 for stitching collated printed products or folded signatures.

* * * * *